US006718933B1

(12) United States Patent
Coates

(10) Patent No.: US 6,718,933 B1
(45) Date of Patent: Apr. 13, 2004

(54) VALVE SEAL FOR ROTARY VALVE ENGINE

(76) Inventor: George J. Coates, Rte. 34 & Ridgewood Rd., Wall Township, NJ (US) 07719

( * ) Notice: Subject to any disclaimer, the term of this patent is extended or adjusted under 35 U.S.C. 154(b) by 31 days.

(21) Appl. No.: 10/280,293

(22) Filed: Oct. 28, 2002

(51) Int. Cl.[7] ..... F01L 7/00

(52) U.S. Cl. ..... 123/190.17; 123/190.14; 251/314

(58) Field of Search ..... 123/190.1, 190.14, 123/190.17; 251/311, 314; 277/500, 586

(56) References Cited

U.S. PATENT DOCUMENTS 4,944,261 A 7/1990 Coates
4,953,527 A 9/1990 Coates
4,976,232 A 12/1990 Coates
4,989,558 A 2/1991 Coates
4,989,576 A 2/1991 Coates
5,109,814 A 5/1992 Coates
5,361,739 A 11/1994 Coates
6,308,676 B1 10/2001 Coates

*Primary Examiner*—Noah P. Kamen
(74) *Attorney, Agent, or Firm*—Clifford G. Frayne

(57) ABSTRACT

A valve seal for a rotary valve assembly for use in an internal combustion engine of the piston and cylinder type, the valve seal having a valve body member having a curved annular upper surface conforming to the spherical periphery of a spherical rotary valve, the valve seal having a centrally disposed aperture therethrough defined by an inner circular side wall, the valve body member having an annular receiving groove formed on its curved upper surface for receipt of a lubricating insert ring, the valve body member further having an outer circumferential side wall having a plurality of mounting ribs for the positioning of lateral sealing rings, the valve body member further having a plurality of radial throughbores formed between the inner circular side wall and the outer circumferential side wall, the throughbores being in the same plane as one of the sealing rings.

6 Claims, 2 Drawing Sheets

VALVE SEAL FOR ROTARY VALVE ENGINE

BACKGROUND OF THE INVENTION

1. Field of the Invention

The present invention relates to an internal combustion engine of the piston-cylinder type having a spherical rotary valve assembly for the introduction of the fuel/air mixture to the cylinder and the evacuation of the exhaust gases, and is particularly directed towards the valve seals for such rotary valve assembly.

2. Description of the Prior Art

The Applicant herein has directed considerable attention to the internal combustion engine of the piston-cylinder type and in particular to the replacement of the poppet valve system, including the poppet valve, springs, mountings and associated cam shaft, with a spherical rotary valve assembly for the introduction of the fuel air mixture into the cylinder and for the evacuation of the exhaust gases. Applicant is the named inventor in U.S. Pat. No. 4,989,576, "Internal Combustion Engine"; U.S. Pat. No. 4,944,261, "Spherical Rotary Valve Assembly for Internal Combustion Engine"; U.S. Pat. No. 4,953,527, "Spherical Rotary Valve Assembly for Internal Combustion Engine"; U.S. Pat. No. 4,976,232, "Valve Seal for Rotary Valve Engine"; U.S. Pat. No. 4,989,558, "Spherical Rotary Valve Assembly for Internal Combustion Engine"; U.S. Pat. No. 5,109,814, "Spherical Rotary Valve"; U.S. Pat. No. 5,361,739, "Spherical Rotary Valve Assembly for Use in a Rotary Valve Internal Combustion Engine"; and U.S. Pat. No. 6,308,676 B1, "Cooling System for Rotary Valve Engine". The aforementioned U.S. Patents are incorporated herein as if set forth in length and in detail.

The present invention which is the subject to this application relates to the valve seal which is positioned between the spherical rotary valve and the cylinder. The upper surface of such valve seal being the surface upon which the spherical periphery of the spherical rotary valve contacts during rotation.

OBJECTS OF THE INVENTION

An object of the present invention is to provide for a novel and improved valve seal for a rotary valve engine.

A further object of the present invention is to provide for a novel and improved valve seal for a rotary valve engine in which the ceramic insert of the valve seal is positioned in a locking angle for improved life span.

A still further object of the present invention is to provide for a novel and improved valve seal for a rotary valve engine in which a gas tight seal is maintained by the pressure developed in the cylinder and combustion chamber.

A still further object of the present invention is to provide for a novel and improved valve seal for a rotary valve engine in which the gas tight seal is obtained by a plurality of pressure holes about the seal providing communication for the compressed gases in the cylinder to act upon the sealing rings about the periphery of the valve seal.

A still further object of the present invention is to provide for an improved and novel valve seal for a spherical rotary valve assembly which requires no external lubrication.

SUMMARY OF THE INVENTION

A valve seal for a rotary valve assembly for use in an internal combustion engine of the piston and cylinder type, wherein the rotary valves are of a spherical section defined by two parallel planes of the sphere, the planes being disposed symmetrically about the center of this sphere defining a spherical periphery and planar end walls, the valve seal being substantially circular in cross section and having a valve body member having a curved annular upper surface conforming to the spherical periphery of the spherical rotary intake and spherical rotary exhaust valve, the valve seal having a centrally disposed aperture therethrough defined by an inner circular side wall coincidental with the aperture and the inlet port and outlet port, the valve body member having an annular receiving groove formed on its curved upper surface for receipt of a lubricating insert ring, the valve body member further having an outer circumferential side wall having a plurality of mounting ribs for the positioning of lateral sealing rings, the valve body member further having a plurality of radial throughbores formed between the inner circular wall defining the aperture and the outer circumferential side wall, the throughbores being in the same plane as one of the sealing rings, thereby permitting compressed gases to exert outward pressure on the sealing ring for contacting the valve seat.

BRIEF DESCRIPTION OF THE DRAWINGS

These and other advantages and improvements will be evident, especially when taken in light of the following illustrations wherein.

DETAILED DESCRIPTION OF THE INVENTION

Figure 1:
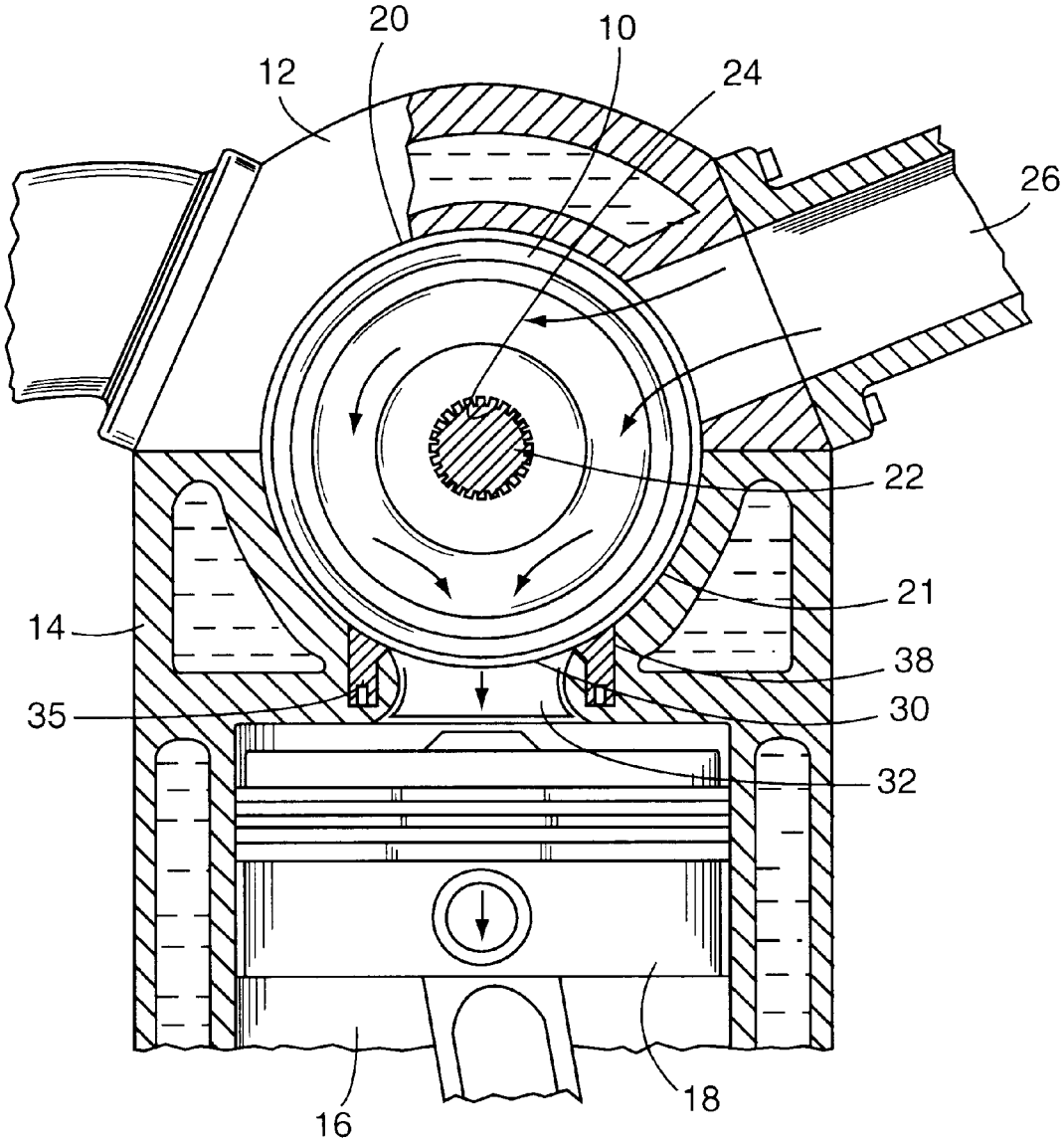
FIG. 1 is an end cross-sectional view of the head of the spherical rotary valve assembly showing the relationship of the spherical rotary valve to the cylinder, piston and valve seal.

Referring to FIG. 1, there is illustrated an end cross-sectional view of an embodiment of the spherical rotary valve assembly of Applicant's prior patents detailing the relationship between a rotary intake valve 10 enclosed within an upper half 12 and lower half 14 of a split head assembly. The split head assembly is secured to an engine block having cylinder 16 within which piston 18 reciprocates.

The split head assembly comprising upper half 12 and lower half 14 defines a drum accommodating cavity 20 within which rotary intake valve 10 is positioned. Rotary intake valve 10 is positioned on shaft 22 which passes through a centrally positioned aperture 24 on the rotary intake valve 10. As discussed in detail in Applicant's prior patents heretofore set forth, rotary intake valve 10 provides for communication between fuel air inlet port 26 and cylinder 16 by means of an aperture 30 positioned on the spherical periphery 21 of the rotary valve 10 which comes into successive registration with inlet port 32 to cylinder 16.

Rotary intake valve 10 rotating within drum accommodating cavity 20 on shaft 22 is in contact with valve seal 35, annularly positioned in an annular groove or seat 38 about inlet port 32 to cylinder 16. Valve seal 35 serves to provide a seal to insure that the fuel/air mixture passes from rotary intake valve 10 into cylinder 16 during the intake stroke and further provides a seal with rotary intake valve 10 during the compression stroke to insure that the ignition of the fuel/air mixture occurs within cylinder 16 and does not migrate into drum accommodating cavity 20. Further, seal 35 provides a seal with rotary intake valve 10 during the exhaust stroke to insure that the exhaust gases exit through the rotary exhaust valve.

The description of valve seal 35 as contained herein is made with respect to a rotary intake valve as shown and illustrated in FIG. 1. Valve seal 35 is of the same design and serves the same purpose and function with respect to its relationship to the rotary exhaust valve of the spherical rotary valve assembly as disclosed in Applicant's prior patents heretofore identified. It is further understood that each cylinder would have at least one rotary intake valve and one rotary exhaust valve and a valve seal associated with each. The improved valve seal described hereafter serves the same purpose of valve seal 35.

Figure 3:
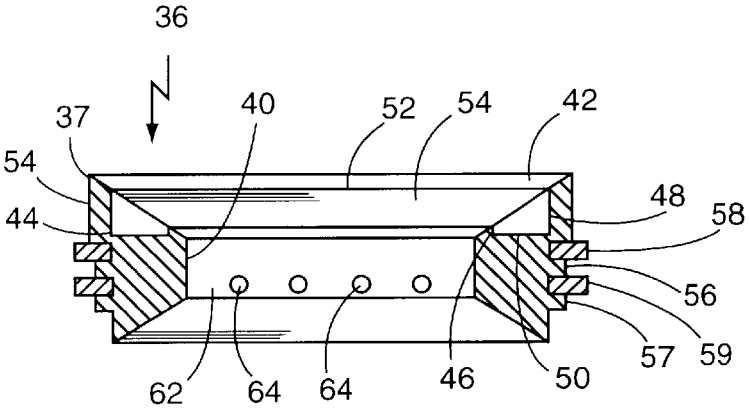
FIG. 3 is a side cutaway view of the improved valve seal of the present invention along plane 3—3 of FIG. 2.
Figure 4:
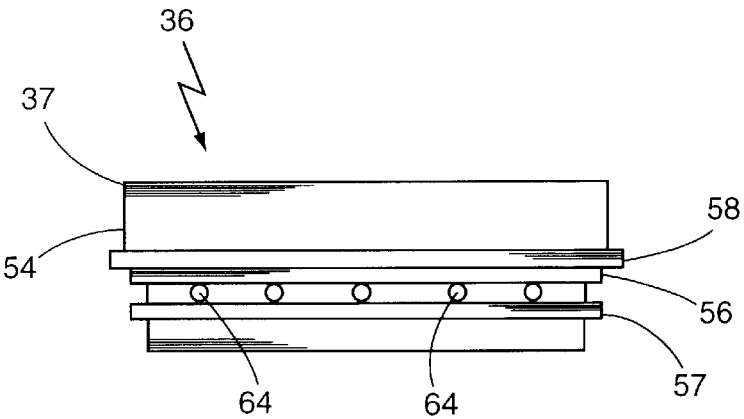
FIG. 4 is a side view of the improved valve seal of the present invention.
Figure 2:
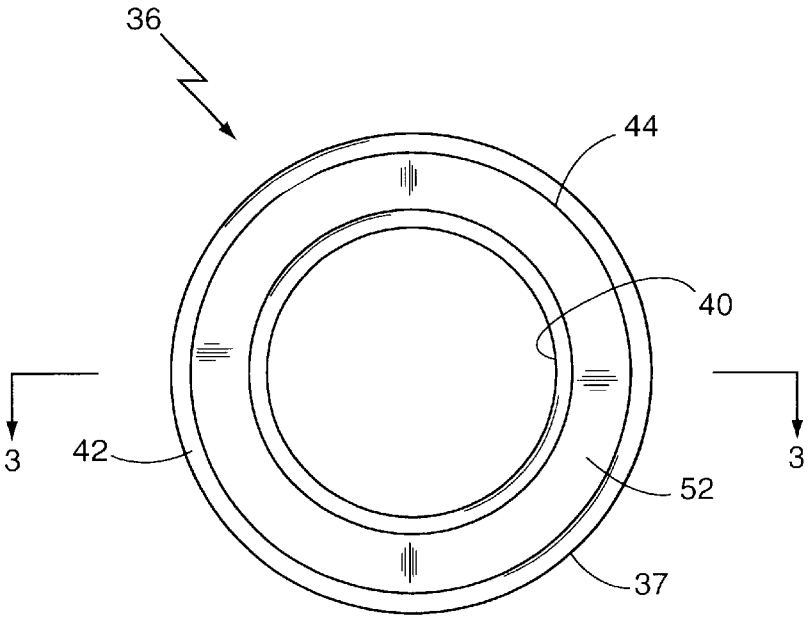
FIG. 2 is a top view of the improved valve seal of the present invention.

Referring now to FIGS. 2, 3, and 4, which are a top, side cutaway, and side view of an improved valve seal 36, which is comprised of a valve seal body 37 and a ceramic carbon insert lubricating ring 52 as more fully described hereafter. Valve seal 36 has a centrally disposed aperture 40 alignable with inlet port 32 when valve seal 36 is seated in annular groove or seat 38. The upper annular surface 42 of valve body 37 is curved inwardly towards the center of aperture 40. This curvature corresponding to the spherical periphery curvature 23 of the rotary intake valve 10. Upper surface 42 of valve body 37 is formed with an annular groove 44 which is defined by an inner side wall 46, outer side wall 48, and base surface 50. The inner side wall 46 forms a 90 degree angle with base surface 50, while outer side wall 48 forms an angle of less than 90 degrees with base surface 50. Annular groove 44 is for receipt of a ceramic carbon insert lubricating ring 52. The carbon insert lubricating ring 52 is positioned in the annular groove 44 such that its upper surface 54 coincides with the curvature of the upper surface 42 of valve body 37. In mating the carbon insert lubricating ring 52 to the valve body 37, valve body 37 would be heated so that it would undergo slight expansion. The ceramic carbon insert lubricating ring 52 would then be inserted into annular groove 44 during its heating process. The valve body 37 would then be allowed to cool. Since outer side wall 48 of the annular groove is slightly offset from 90 degrees in the direction of inner side wall 46, the ceramic carbon insert lubricating ring 52 is locked in position by this "locking angle" and is assured of remaining in position regardless of how hot the valve seal 36 became during the combustion process of the internal combustion engine. This is particularly important when the internal combustion engine to which the valve seal is affixed is being powered by natural gas which generates substantially higher temperatures than conventional gasoline or diesel fuel.

The outer side wall 54 of valve seal 36 is stepped and formed with a plurality of spaced apart annular ribs 56 and 57 for the receipt and positioning of a sealing or blast rings 58 and 59 which function much like a piston ring establishing a seal between valve seal 36 side wall 54 and the periphery of annular groove or seat 38 about inlet port 32. In the present embodiment there is illustrated two ribs 56 and 57 and two sealing or blast rings 58 and 59.

There is further formed on valve seal 36, between its outer side wall 60 and its inner side wall 62 which defines aperture 40 a plurality of radial throughbores 64 formed about the periphery which permit communication of gases from the cylinder head through the side wall 54 of valve seal 36 and to communicate against sealing ring 59. This design enhances the sealing and seating of valve seal 36 when the piston is moving upwardly under a compression stroke. In such a situation, the rotary intake valve 10 would have rotated such that its spherical periphery 21 had closed aperture 40 of valve seal 36. The piston, under compression stroke would compress the gases within the cylinder head. The throughbores 64 allow these compressed gases to exercise pressure on sealing ring 58 and in turn force sealing ring 58 into contact with the wall of valve seat 38.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A valve seal for a rotary valve assembly for use in internal combustion engines of the piston and cylinder type, the rotary valve assembly positioned within a two piece cylinder head, said cylinder head defining a plurality of drum accommodating cavities for receipt of a plurality of rotary intake valves and rotary exhaust valves, said rotary intake valves and said rotary exhaust valves having a spherical section defined by two parallel planes of the sphere, said planes being disposed symmetrically about the center of said sphere, defining a spherical periphery and planar end walls, said rotary intake valves and said rotary exhaust valves mounted on the shaft means within said drum accommodating cavities in gas tight sealing contact with an inlet port and an exhaust port respectively, said rotary intake valve and said rotary exhaust valves having passageways therethrough for the introduction and interruption of fuel air mixture to the engine and the evacuation of exhaust gases from the engine respectively, said gas tight sealing contact of said rotary intake valve and said rotary exhaust valve of said intake port and said exhaust port, respectively, accomplished by a valve seal and a valve seat, the valve seal comprising:

a valve body member, substantially circular in cross section, said valve body member having a curved annular upper surface conforming to said spherical periphery of said intake valve or said exhaust valve, said valve body member having an aperture therethrough defined by an inner circular side wall coincidental with said aperture of said inlet port or said outlet port, said valve body member having an annular receiving groove formed on said curved upper surface about said aperture for receipt of a lubricating insert ring, said lubricating insert ring having a curved upper surface complimentary to said curved upper surface of said valve body member;

said valve body member further having an outer circumferential side wall having formed thereon a plurality of mounting ribs for the positioning about said outer circumferential side wall of said valve body member of a plurality of lateral sealing rings for sealing said valve body member in said valve seat;

said valve body member further having a plurality of radial throughbores formed between said inner circular wall defining said aperture in said valve body member and said outer circumferential side wall, said throughbores being in the same plane as one of said sealing rings, thereby permitting compressed gases to exert outward pressure on said sealing ring.

2. A valve seal for a rotary valve engine in accordance with claim 1 wherein said annular receiving groove in said valve body member is formed with a vertical inner wall member, a planar base and an angled outer wall member forming an acute angle with said base in the direction of said inner wall member.

3. A valve seal for a rotary valve engine in accordance with claim 2 wherein said lubricating insert ring is of a cross section identical to said annular receiving groove.

4. A valve seal for a rotary valve engine in accordance with claim 1 wherein said lubricating insert ring is comprised of ceramic carbon.

5. A valve seal for a rotary valve engine in accordance with claim 1 wherein said lubricating insert ring is comprised of carbon fiber.

6. A valve seal for a rotary valve engine in accordance with claim 1 wherein said plurality of lateral sealing rings numbers 2.

* * * * *